US007059972B2

(12) United States Patent
Miyamoto

(10) Patent No.: US 7,059,972 B2
(45) Date of Patent: Jun. 13, 2006

(54) GOLF CLUB HEAD

(75) Inventor: Masahiko Miyamoto, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 09/842,051

(22) Filed: Apr. 26, 2001

(65) Prior Publication Data

US 2002/0002084 A1 Jan. 3, 2002

(30) Foreign Application Priority Data

May 15, 2000 (JP) ..... 2000-142063

(51) Int. Cl.
*A63B 53/04* (2006.01)

(52) U.S. Cl. ..... 473/330; 473/345

(58) Field of Classification Search ..... 473/330, 473/331, 345, 346, 342, 324, 349, 288
See application file for complete search history.

(56) References Cited

U.S. PATENT DOCUMENTS 1,525,137 A * 2/1925 Lawton ..... 473/330
2,023,885 A * 12/1935 Hinckley
3,652,093 A * 3/1972 Reuter, Jr. ..... 473/340
3,941,390 A * 3/1976 Hussey ..... 473/292
3,966,210 A * 6/1976 Rozmus ..... 473/341
3,989,257 A * 11/1976 Barr
4,065,133 A * 12/1977 Gordos ..... 473/327
4,162,074 A * 7/1979 Thomson
4,367,878 A * 1/1983 Schmidt
4,471,961 A * 9/1984 Masghati
4,521,022 A * 6/1985 Schmidt
4,872,683 A * 10/1989 Doran et al. ..... 473/249
5,303,923 A * 4/1994 Garcia
5,310,185 A * 5/1994 Viollaz
5,354,059 A * 10/1994 Stuff ..... 473/329
5,377,986 A * 1/1995 Viollaz
5,378,295 A * 1/1995 Yamashita et al. ..... 148/654
5,382,019 A * 1/1995 Sneed
5,569,337 A * 10/1996 Yoshida et al. ..... 148/325
5,573,467 A * 11/1996 Chou
5,645,495 A * 7/1997 Saso
5,681,228 A * 10/1997 Mikame
6,139,445 A * 10/2000 Werner
6,183,380 B1 * 2/2001 Yim ..... 473/330
6,344,002 B1 * 2/2002 Kajita
6,454,664 B1 * 9/2002 Long
6,458,043 B1 * 10/2002 McCabe

* cited by examiner

*Primary Examiner*—Sebastiano Passaniti
(74) *Attorney, Agent, or Firm*—Finnegan, Henderson, Farabow, Garrett & Dunner, L.L.P.

(57) ABSTRACT

Disclosed is a golf club head, in which a face surface is divided into upper and lower portions by a boundary line across a position of a sweet spot thereof, a roll radius of the upper portion is set at 305 mm or less, and a roll radius of the lower portion is set at 310 mm or more.

7 Claims, 1 Drawing Sheet

GOLF CLUB HEAD

BACKGROUND OF THE INVENTION

The present invention relates to a golf club head where a curvature is given to a face surface, more particularly, to a golf club head in which a loss of carry due to reduction of a launching angle is prevented and variance of carry due to difference of a ball striking position in an upper/lower direction is suppressed.

Generally, the curvature, which is called a roll, that curves in the upper/lower direction (a vertical direction when a golf club is held) is given on the face surface of a wood type golf club head. A roll radius is usually set to be constant across the entire face surface.

As described above, in the golf club head where the curvature of a constant roll radius is given to the face surface, a substantial loft angle at a portion lower than a center of the face surface is smaller. As a result, a struck ball did not rise as expected when the ball was struck at the lower face surface of the golf club head, which caused a problem of a carry loss. Specifically, in the case where the ball striking position is made at the lower face surface, although an initial ball velocity increases a little with a presence of the roll, a reduction of the launching angle influences more to the carry than the increase of the initial ball velocity.

Moreover, in the above-described golf club head, the carry at the lower ball striking position is insufficient. There has been a problem that variance of the carry became large when the ball striking position changed in the upper/lower direction.

SUMMARY OF THE INVENTION

The object of the present invention is to provide a golf club head in which a loss of carry due to reduction of a launching angle when a ball is struck at a lower portion of a face surface is prevented and variance of carry due to difference of a ball striking position in an upper/lower direction is suppressed.

The golf club head of the present invention, in order to achieve the above-described object, is characterized in that a face surface is divided into upper and lower portions by a boundary line across a position of a sweet spot thereof, a roll radius of the upper portion is set at 305 mm or less, and a roll radius of the lower portion is set at 310 mm or more.

Thus, by setting the roll radius of the portion lower than the sweet spot position of the face surface large, that is, by setting the curvature of the lower portion small, the substantial loft angle at the lower ball striking position can be made large to cause a large launching angle, and the loss of carry at the lower ball striking position can be reduced. Moreover, since the loss of carry at the lower ball striking position is reduced, the variance of the carry due to a different ball striking position in the upper/lower direction can be suppressed.

In the present invention, while the upper portion of the face surface is constituted of a curved surface based on the above-described roll radius, the lower portion may be constituted of a plane surface by infinitely increasing the roll radius.

Note that the sweet spot is a position where a perpendicular line drawn from a center of gravity of the golf club head to the face surface and the face surface intersect, which exists near the center of the face surface.

DETAILED DESCRIPTION OF THE PREFERRED EMBODIMENT

A constitution of the present invention will next be described in detail with reference to the accompanied drawings.

Figure 1:
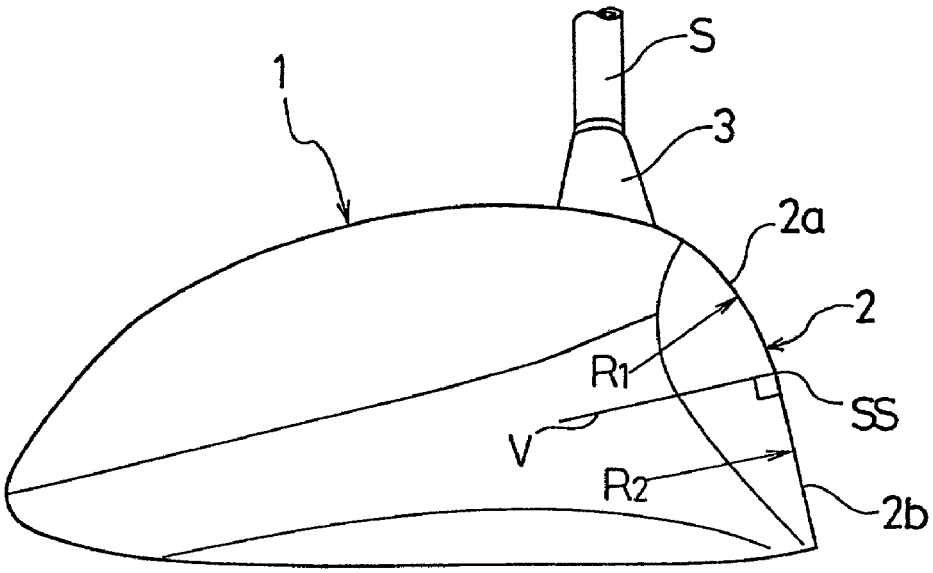
FIG. 1 is a side view showing a golf club head according to an embodiment of the present invention.
Figure 2:
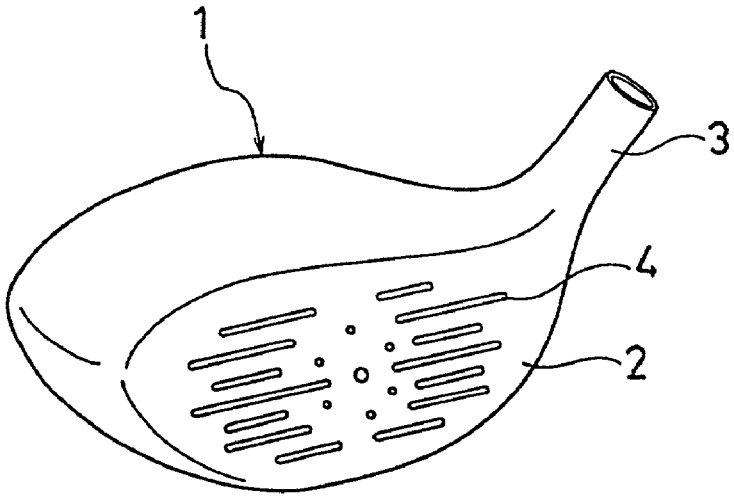
FIG. 2 is a perspective view showing a golf club head according to the embodiment of the present invention.

FIG. 1 and FIG. 2 are the one showing a wood type golf club head according to an embodiment of the present invention. In the figures, a golf club head 1 of a hollow structure has a face surface 2 in the front, and is constituted of a metal material such as titanium, stainless steel and aluminum. A pipelike hosel portion 3 is integrally provided at a heel side of the golf club head 1, and a shaft S is joined via the hosel portion 3. In addition, scores 4 with an arbitrary pattern can be provided on the face surface 2.

As shown in FIG. 1, a sweet spot SS exists on a position where a perpendicular line V drawn from a center of gravity of the head to the face surface 2 and the face surface 2 intersect. With the position of the sweet spot SS set as a border, a roll radius $R_1$ of an upper portion 2*a* of the face surface 2 is set at 305 mm or less, and a roll radius $R_2$ of a lower portion 2*b* of the face surface 2 is set at 310 mm or more. In the embodiment, the upper portion 2*a* of the face surface 2 is constituted of a curved surface based on the above-described roll radius $R_1$, and the lower portion 2*b* is constituted of a plane surface having the roll radius $R_2$ as infinite.

According to the above-described golf club head, the roll radius $R_2$ of the lower portion 2*b* is increased while the roll radius $R_1$ of the upper portion 2*a* is reduced. Therefore, a substantial loft angle when the ball is struck at the lower portion 2*b* can be made large to cause a large launching angle. As a result, the loss of carry at the lower ball striking position can be reduced. Moreover, the variance of the carry due to a different ball striking position in the upper/lower direction can be suppressed by reducing the loss of carry at the lower ball striking position.

In the present invention, it is necessary that the roll radius $R_1$ of the upper portion 2*a* is set at 305 mm or less and the roll radius $R_2$ of a lower portion 2*b* is set at 310 mm or more. If the roll radius $R_1$ of the upper portion 2*a* exceeds 305 mm, carry at the upper ball striking position reduces. And, if the roll radius $R_2$ of a lower portion 2*b* is less than 310 mm, carry at the lower ball striking position becomes insufficient. Note that the roll radius $R_1$ of the upper portion 2*a* is more preferably set at 260 mm or less with its lowest value set at 152 mm.

Note that the description has been made for the wood type golf club head in the above-described embodiment. The present invention can be applied to a golf club head of an iron type, and effects similar to the case for the wood type can be obtained for the case of the iron type.

EXAMPLES

Golf club heads of comparative examples 1 to 7 and the embodiments 1 to 6 having different face surface shapes were fabricated.

Comparative Example 1

Curvature of a constant roll radius R was given to an entire face surface, and its roll radius was set at 203 mm.

Comparative Example 2

Curvature of a constant roll radius R was given to an entire face surface, and its roll radius was set at 254 mm.

Comparative Example 3

Curvature of a constant roll radius R was given to an entire face surface, and its roll radius was set at 305 mm.

Comparative Example 4

Curvature of a constant roll radius R was given to an entire face surface, and its roll radius was set at 356 mm.

Comparative Example 5

Curvature of a constant roll radius R was given to an entire face surface, and its roll radius was set at 406 mm.

Comparative Example 6

A face surface was constituted of a plane surface (no curvature).

Comparative Example 7

With a position of a sweet spot of a face surface set as a border, an upper portion of the face surface was constituted of a curved surface setting its roll radius $R_1$ at 310 mm, a lower portion of the face surface was constituted of a curved surface setting its roll radius $R_2$ at 356 mm, thereby a compound surface of these curved surfaces was made.

Embodiment 1

With a position of a sweet spot of a face surface set as a border, an upper portion of the face surface was constituted of a curved surface setting its roll radius $R_1$ at 203 mm, a lower portion of the face surface was constituted of a plane surface, thereby a compound surface of the curved surface and the plane surface was made.

Embodiment 2

With a position of a sweet spot of a face surface set as a border, an upper portion of the face surface was constituted of a curved surface setting its roll radius $R_1$ at 254 mm, a lower portion of the face surface was constituted of a curved surface setting its roll radius $R_2$ at 356 mm, thereby a compound surface of these curved surfaces was made.

Embodiment 3

With a position of a sweet spot of a face surface set as a border, an upper portion of the face surface was constituted of a curved surface setting its roll radius $R_1$ at 305 mm, a lower portion of the face surface was constituted of a curved surface setting its roll radius $R_2$ at 406 mm, thereby a compound surface of these curved surfaces was made.

Embodiment 4

With a position of a sweet spot of a face surface set as a border, an upper portion of the face surface was constituted of a curved surface setting its roll radius $R_1$ at 305 mm, a lower portion of the face surface was constituted of a curved surface setting its roll radius $R_2$ at 310 mm, thereby a compound surface of these curved surfaces was made.

Embodiment 5

With a position of a sweet spot of a face surface set as a border, an upper portion of the face surface was constituted of a curved surface setting its roll radius $R_1$ at 260 mm, a lower portion of the face surface was constituted of a curved surface setting its roll radius $R_2$ at 310 mm, thereby a compound surface of these curved surfaces was made.

Embodiment 6

With a position of a sweet spot of a face surface set as a border, an upper portion of the face surface was constituted of a curved surface setting its roll radius $R_1$ at 152 mm, a lower portion of the face surface was constituted of a curved surface setting its roll radius $R_2$ at 310 mm, thereby a compound surface of these curved surfaces was made.

These golf club heads of the comparative examples 1 to 7 and the embodiments 1 to 6 were attached to shafts to constitute golf clubs. Balls were struck with a condition of a head speed at 40 m/s and different ball striking positions by using a swing robot ("Shotrobo" manufactured by Miyamae Co., Ltd.), and carries were measured. The results are shown in Table 1.

The above-described carry is a mean value (m) obtained from five times of measurements at each ball striking position for each golf club. The ball striking position was displaced from the sweet spot position in a head upper/lower direction, and was shown by a distance (mm) from the sweet spot. A minus value means the ball striking position lower than the sweet spot, and a plus value means the ball striking position higher than the sweet spot.

TABLE 1

(Result of carry measurement)

| | Constitution of face | Roll radius of face surface | Ball striking position (upper/lower position from sweet spot)(mm) | | | | | | | |
|---|---|---|---|---|---|---|---|---|---|---|
| | | | −15 | −10 | −5 | 0 | 5 | 10 | 15 | Mean value |
| Comparative example 1 | Single curvature | R = 203 mm | 144.3 m | 172.5 m | 180.4 m | 185.5 m | 186.7 m | 186.0 m | 182.7 m | 176.9 m |
| Comparative example 2 | Single curvature | R = 254 mm | 150.0 m | 175.1 m | 181.3 m | 184.9 m | 185.4 m | 183.8 m | 184.5 m | 177.9 m |

TABLE 1-continued (Result of carry measurement)

| | Constitution of face | Roll radius of face surface | Ball striking position (upper/lower position from sweet spot)(mm) | | | | | | | |
|---|---|---|---|---|---|---|---|---|---|---|
| | | | −15 | −10 | −5 | 0 | 5 | 10 | 15 | Mean value |
| Comparative example 3 | Single curvature | R = 305 mm | 155.3 m | 176.3 m | 182.2 m | 185.0 m | 184.4 m | 181.9 m | 178.1 m | 177.6 m |
| Comparative example 4 | Single curvature | R = 356 mm | 162.8 m | 178.6 m | 183.7 m | 184.7 m | 183.0 m | 176.3 m | 172.6 m | 177.4 m |
| Comparative example 5 | Single curvature | R = 406 mm | 168.9 m | 180.6 m | 184.5 m | 184.9 m | 179.1 m | 168.7 m | 166.2 m | 176.1 m |
| Comparative example 6 | Plane surface | R = ∞ | 174.2 m | 182.5 m | 184.8 m | 183.6 m | 178.0 m | 168.7 m | 165.9 m | 176.8 m |
| Comparative example 7 | Compound curvature | Upper: $R_1$ = 310 mm Lower: $R_2$ = 356 mm | 162.1 m | 177.8 m | 183.1 m | 184.0 m | 183.4 m | 178.6 m | 176.0 m | 177.9 m |
| Embodiment 1 | Compound curvature | Upper: $R_1$ = 203 mm Lower: $R_2$ = ∞ | 174.1 m | 182.4 m | 184.2 m | 184.1 m | 186.5 m | 185.4 m | 181.9 m | 182.7 m |
| Embodiment 2 | Compound curvature | Upper; $R_1$ = 254 mm Lower: $R_2$ = 356 mm | 162.2 m | 178.1 m | 182.9 m | 184.6 m | 185.1 m | 182.9 m | 182.1 m | 179.7 m |
| Embodiment 3 | Compound curvature | Upper: $R_1$ = 305 mm Lower: $R_2$ = 406 mm | 168.7 m | 179.9 m | 184.2 m | 184.8 m | 184.2 m | 181.6 m | 177.9 m | 180.2 m |
| Embodiment 4 | Compound curvature | Upper: $R_1$ = 305 mm Lower: $R_2$ = 310 mm | 158.3 m | 177.1 m | 182.9 m | 184.9 m | 184.3 m | 181.9 m | 177.2 m | 178.1 m |
| Embodiment 5 | Compound curvature | Upper: $R_1$ = 260 mm Lower: $R_2$ = 310 mm | 158.2 m | 176.8 m | 183.0 m | 185.1 m | 185.3 m | 183.6 m | 183.9 m | 179.4 m |
| Embodiment 6 | Compound curvature | Upper: $R_1$ = 152 mm Lower: $R_2$ = 310 mm | 158.1 m | 176.9 m | 183.2 m | 185.1 m | 186.2 m | 182.1 m | 176.1 m | 178.2 m |

As understood from Table 1, the golf club heads of the comparative examples 1 to 3, whose roll radius R were made small across the entire face surface, had reduced carries at the ball striking positions lower than the sweet spot despite the upper ball striking positions had large carries. In addition, the golf club heads of the comparative examples 4 to 6, whose roll radius R were made large across the entire face surface, had reduced carries by the ball striking positions higher than the sweet spot despite the lower ball striking positions had large carries.

On the other hand, the golf club heads of the embodiments 1 to 6, where the roll radius $R_2$ of the lower portion of the face surface were made large while the roll radius $R_1$ of the upper portion was made small, had increased carries at both of the ball striking positions higher and lower than the sweet spot. Specifically, stable carries were obtained irrespective of the difference of the upper/lower ball striking positions. Note that the comparative example 7 had an insufficient effect despite its face surface having the compound curvature.

As described above, according to the present invention, a face surface is divided into upper and lower portions by a boundary line across a position of a sweet spot thereof, a roll radius of the upper portion is set at 305 mm or less, and a roll radius of the lower portion is set at 310 mm or more. Therefore, the loss of carry due to reduction of a launching angle when the ball is struck at the lower position of the face surface is prevented and variance of carry due to difference of the ball striking position in an upper/lower direction is suppressed.

What is claimed is:

1. A wood-type golf club head comprising:

a face surface having upper and lower portions separated by a boundary line across the position of a sweet spot on the face surface, said face surface being free of a face surface portion at said boundary line other than said upper and lower portions of said face surface, said upper portion having a roll radius of between 152 mm and 305 mm and said lower portion having a roll radius of 310 mm or more.

2. The golf club head according to claim 1, comprising a metallic hollow structure.

3. A wood-type golf club head comprising:

a face surface having upper and lower portions separated by a boundary line across the position of a sweet spot on the face surface, said upper portion and said lower portion being in contact with each other at said boundary line, said upper portion having a roll radius of between 152 mm and 305 mm and said lower portion having a roll radius of 310 mm or more.

4. A wood-type golf club head comprising:

a face surface having upper and lower portions separated by a boundary line across the position of a sweet spot on the face surface, said upper portion contacting said lower portion across the entire face surface at said boundary line, said upper portion having a roll radius of between 152 mm and 305 mm and said lower portion having a roll radius of 310 mm or more.

5. The golf club head according to claims 1, 3 or 4, comprising a metallic hollow structure.

6. The golf club head according to claims 1, 3 or 4, wherein said lower portion is formed by a plane surface while said upper portion is formed by a curved surface.

7. The golf club head according to claim 6, comprising a metallic hollow structure.

* * * * *